US007410452B2

(12) United States Patent
Nishibe et al.

(10) Patent No.: US 7,410,452 B2
(45) Date of Patent: Aug. 12, 2008

(54) POUCH WITH A STRAW HOLE AND METHOD OF MANUFACTURING THE SAME

(75) Inventors: Akira Nishibe, Nagoya (JP); Charles Murray, Sarasota, FL (US)

(73) Assignee: Pouch Pac International, LLC, Sarasota, FL (US)

( * ) Notice: Subject to any disclaimer, the term of this patent is extended or adjusted under 35 U.S.C. 154(b) by 533 days.

(21) Appl. No.: 11/057,635

(22) Filed: Feb. 14, 2005

(65) Prior Publication Data

US 2005/0175262 A1 Aug. 11, 2005

Related U.S. Application Data

(62) Division of application No. 10/255,014, filed on Sep. 25, 2002, now abandoned.

(51) Int. Cl.
*B31B 1/72* (2006.01)

(52) U.S. Cl. ..... 493/116; 493/189; 493/197; 493/202

(58) Field of Classification Search ..... 493/116, 493/150, 189, 196, 197, 199, 200, 202, 209, 493/229, 235

See application file for complete search history.

(56) References Cited

U.S. PATENT DOCUMENTS 4,120,715 A * 10/1978 Ockwell et al. ..... 156/252
4,553,693 A 11/1985 Terajima et al. ..... 229/75
4,631,905 A * 12/1986 Maloney ..... 53/554
4,793,121 A * 12/1988 Jamison ..... 53/410
4,954,124 A * 9/1990 Erickson et al. ..... 493/195
5,244,450 A * 9/1993 Koehn ..... 493/195
5,254,073 A * 10/1993 Richison et al. ..... 493/195
5,350,240 A * 9/1994 Billman et al. ..... 383/104
5,425,583 A 6/1995 Wild ..... 383/202
5,571,361 A * 11/1996 Stuerzel ..... 156/252
5,765,345 A * 6/1998 Svec ..... 53/453
5,833,368 A 11/1998 Kaufman ..... 383/205
5,868,658 A * 2/1999 Wild ..... 493/212
5,873,656 A 2/1999 Arkins et al. ..... 383/202
5,997,177 A 12/1999 Kaufman ..... 383/5
7,175,581 B2 * 2/2007 Murray ..... 493/186

* cited by examiner

*Primary Examiner*—Sameh H. Tawfik
(74) *Attorney, Agent, or Firm*—Gifford, Krass, Sprinkle, Anderson & Citkowski, P.C.

(57) ABSTRACT

A method of manufacturing a pouch with a straw hole is provided that includes the steps of feeding a front-side film forming one panel of the pouch and a back-side film forming an other panel, from a roll of material, and punching a straw hole in one panel of the pouch. The method also includes the steps of feeding a seal material tape with a plurality of temporally punched portions, and each temporal punched portion has a size slightly larger than that of the straw hole, to a rear side of the panel with the straw hole. The method further includes the steps of temporally sealing the temporally punched portion of the seal material tape over the straw hole by aligning one temporally punched portion of the seal material tape with the straw hole, separating the temporally punched portion from the seal material tape and temporally sealing the temporally punched portion to the one panel. The method still further includes the steps of finally sealing the temporally punched portion to the one panel and sealing a side edge and a bottom edge of the one panel to the other panel to form the pouch.

3 Claims, 6 Drawing Sheets

POUCH WITH A STRAW HOLE AND METHOD OF MANUFACTURING THE SAME

RELATED APPLICATION

This application is a divisional of U.S. patent application Ser. No. 10/255,014 filed Sep. 25, 2002.

FIELD OF THE INVENTION

The present invention relates to a pouch making it possible for users to insert a straw from a straw hole into inside the inside of the pouch for drinking such drinks as juice or milk therein as well as to a method of manufacturing the same.

BACKGROUND OF THE INVENTION

In a case of a pouch for drinks with a straw hole, the pouch is automatically manufactured by a bag making machine, so that substantial contrivance is required for sealing the straw hole from inside of the pouch.

In one of the methods known currently, a seal tape 22 is set inside the pouch in the horizontal direction as shown in FIG. 5 so that the seal tape 22 covers the straw hole 21 from inside thereof, and a circumference of the straw hole 21 indicated by the sign W in FIG. 7 and portions 24, 24*a* crossing the side seals 23, 23*a* in FIG. 5 and FIG. 6 respectively are heat-sealed.

Because of this feature, inside the pouch 20, a portion other than the heat-sealed area of the seal tape 22 is separated from the pouch 20 toward the content therein as shown in FIGS. 6 and 7, and this separated portion of the tape 22*a* sometimes cause troubles in filling content in the bag. Further the thickness of the sections where side seals 24, 24*a* are applied to the seal tape 22 is larger by the thickness of the seal tape 22 than that side seals 23 and 23*a*, so that sometimes pin holes may be generated due to a fault in heat sealing, and if the temperature for heat sealing is raised to address generating the pin holes, excessive heat is applied to other side seals 23 and 23*a*, which in turn may generate pin holes there.

In addition, as the thickness of the pouch 20 in the section where the seal tape 22 is applied becomes larger as compared to those in other areas thereof, and when these pouches 20 are set in a magazine of an automatic filling machine or the like, the pouches 20 are not well aligned, which may easily cause troubles.

Further, the content is easily stuck to and deposited on the tape 22*a*, and fungus or bacteria deposited on the tape 22*a* may cause contamination of the content.

OBJECTS OF THE INVENTION

The present invention was made in the light of the circumstances as described above, and it is an object of the present invention to provide a sanitary pouch with a straw hole which causes no trouble when the content is filled therein, and which does not generate any pin holes in the side-sealed sections, and also which does not cause any trouble in an automatic filling machine, and to provide a method of manufacturing the pouch with a straw hole.

DETAILED DESCRIPTION OF THE INVENTION

Figure 1A:
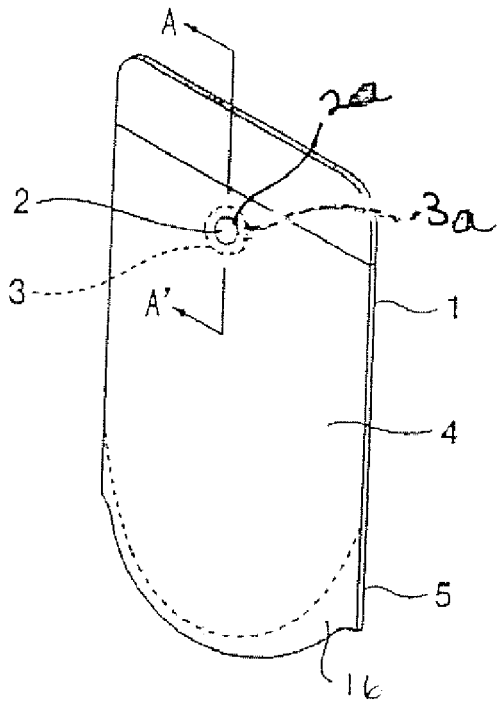
FIG. 1A is an explanatory view showing a standing pouch according to the present invention.
Figure 1B:
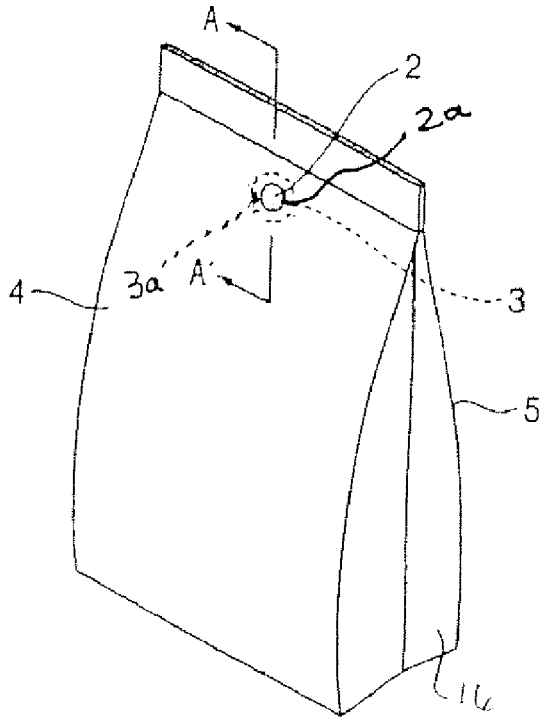
FIG. 1B is an explanatory view showing a gazette pouch according to the present invention.
Figure 1C:
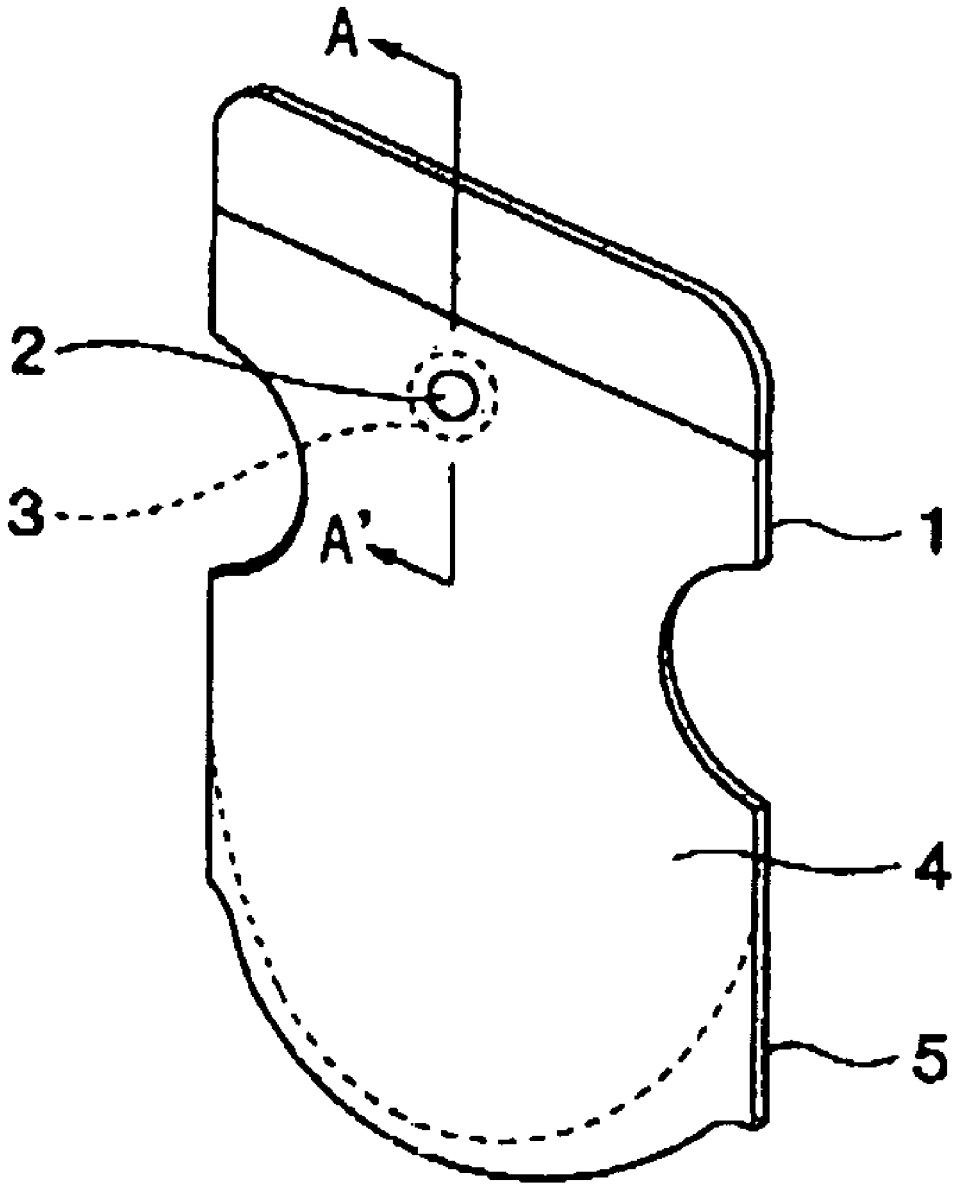
FIG. 1C is an explanatory view showing a standing pouch having cutting portion on the both sides.
Figure 2:
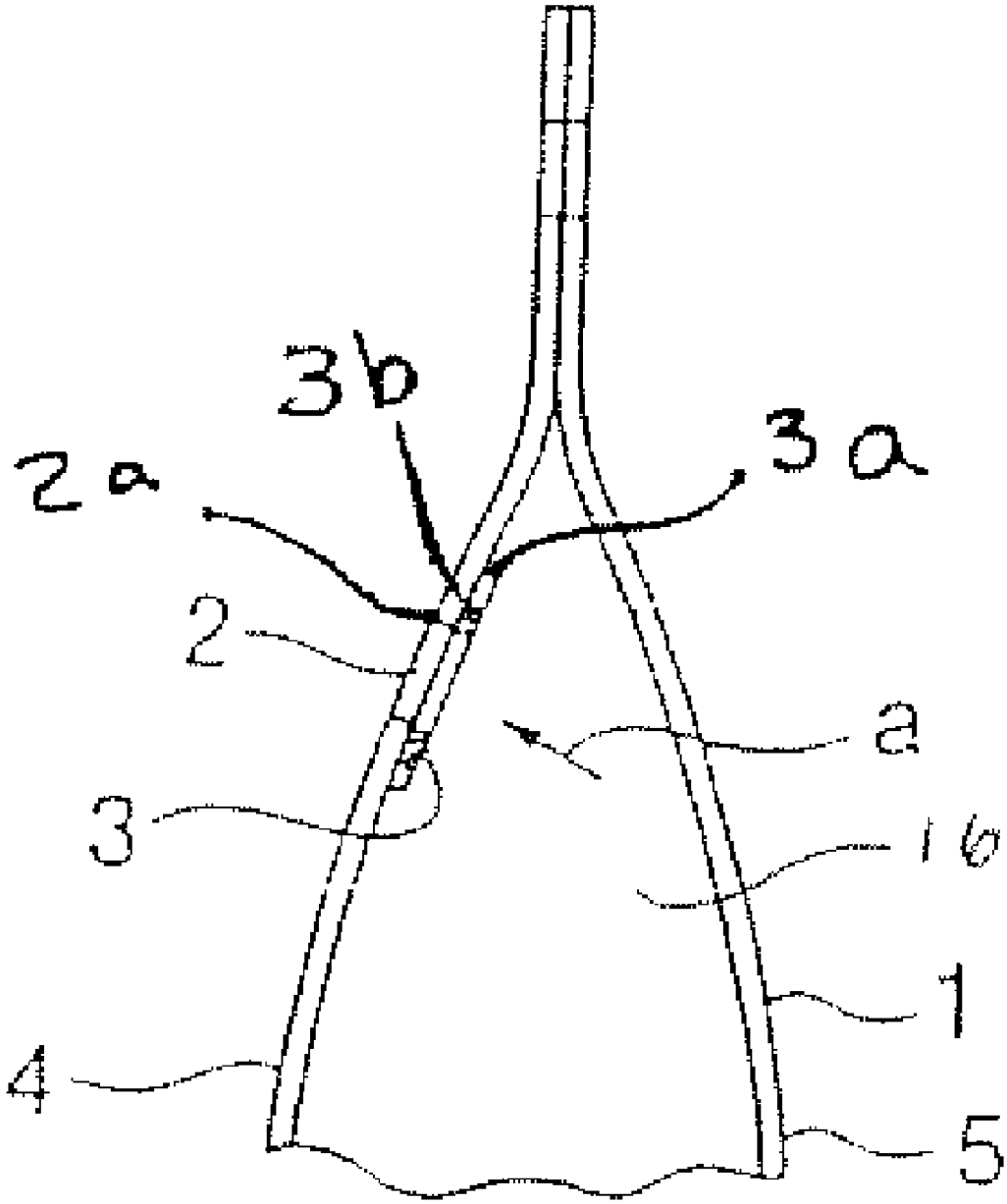
FIG. 2 is a view showing a cross section taken along the line A-A' in FIG. 1.
Figure 3:
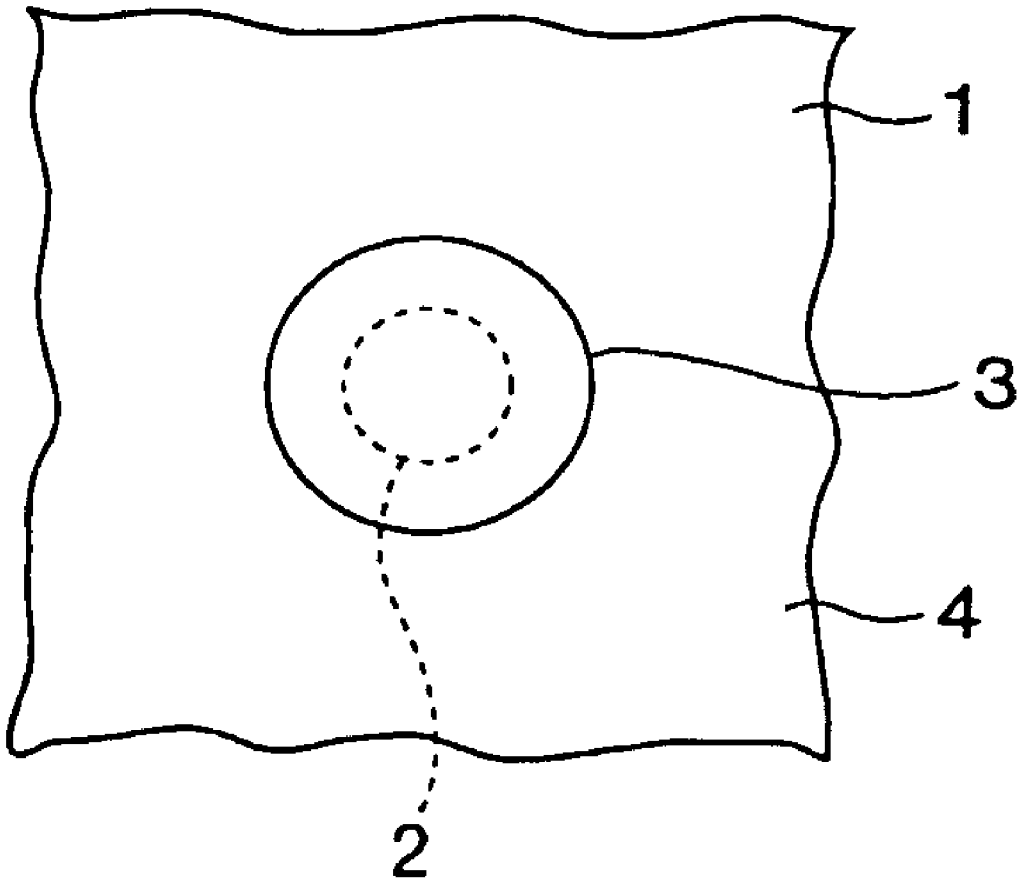
FIG. 3 is a front view seen in the direction a in FIG. 2.

FIGS. 1 to 3 each show a pouch according to the present invention. The pouch includes a front panel and a back panel. Each panel has a top edge, bottom edge, and side edges disposed between the top and bottom edge. The pouch may include a gusset 16 inserted between two parallel edges, to form a pouch capable of standing up. The gusset 16 may be formed from a folded tape of material.

The pouch 1 according to the present invention has a straw hole sealing material 3 with a circumference shown at 3*a* that is slightly larger than a straw hole 2 formed on a front-side film. The straw hole 2 also has a predetermined circumference shown at 2*a*. The straw hole sealing material 3 is first temporarily heat sealed to the back side of the front-side film over the straw hole 2. It should be appreciated that a peripheral portion of the straw hole sealing material is temporarily sealed to the back side of the front-side film around the straw hole 2 and has a temporary heat seal width as shown at 3*b*. The straw hole sealing material 3 is then permanently heat sealed to the back side of the front-side film and the permanent heat seal width shown at 3*c* is applied over the temporary heat seal width. Further, the circumference 3*a* of the straw hole sealing material 3 is slightly larger than that of either the permanent heat seal width 3*c* or temporary heat seal width 3*b*, and the permanent heat seal width 3*c* is slightly greater than the temporary heat seal width 3*b*. For example, the temporary heat seal with is 2 mm and the permanent heat seal width 3*c* is 2.5 mm. The temporary heat seal and permanent heat seal may be applied using a thermal heat sealing process, or an ultrasonic heat sealing process, or a combination of these processes. The temporary heat seal is preferably a "tack" seal that softens the film so that the patch sticks to the back side of the front-side film. The tack seal is a fast, high temperature with minimum time and pressure heat seal process, while the permanent seal is a lower temperature and pressure. A two-seal process is advantageous in enhancing the seal strength and durability.

Figure 4:
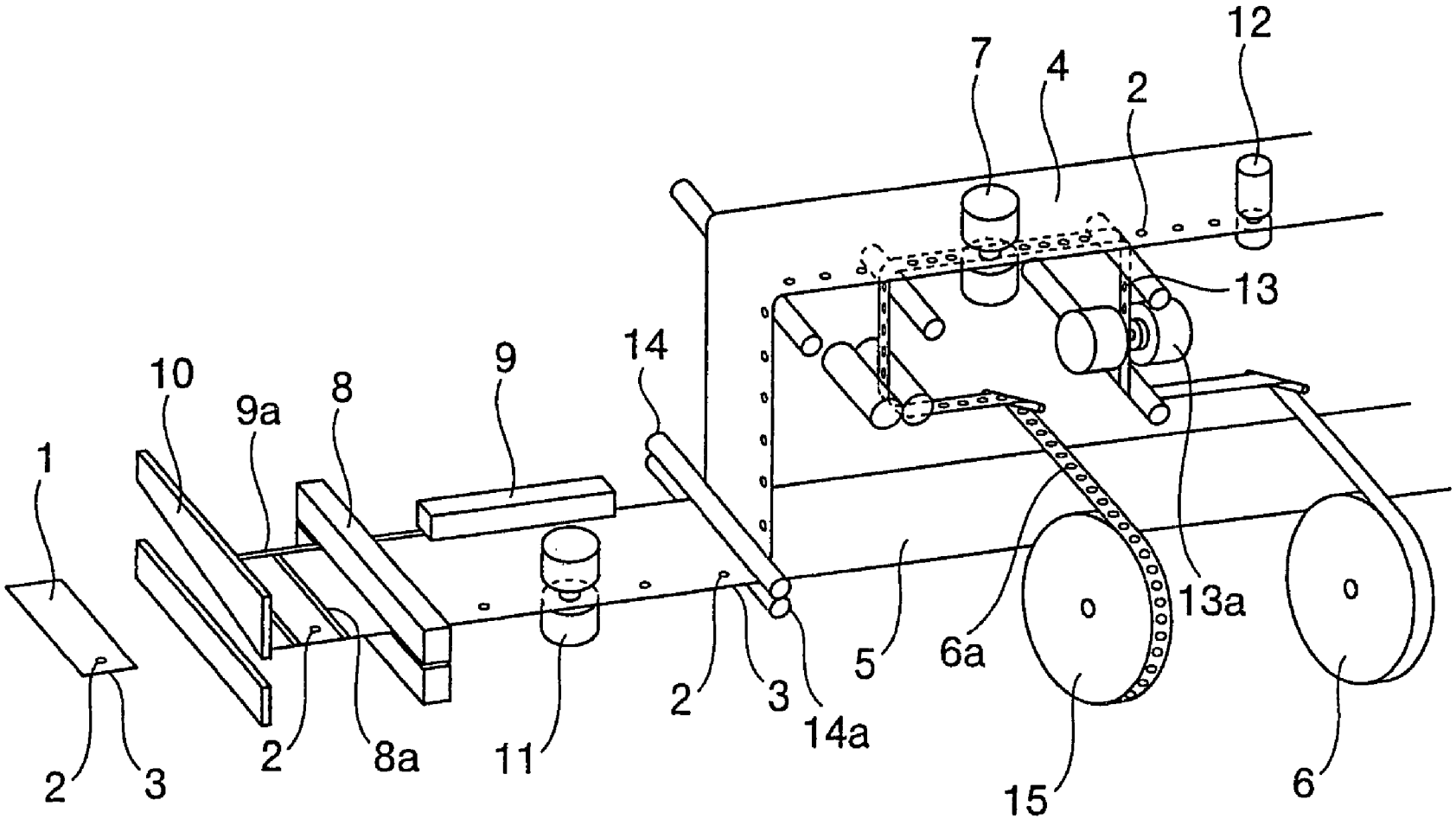
FIG. 4 is an explanatory view for a method of manufacturing the pouch according to the present invention.
Figure 5:
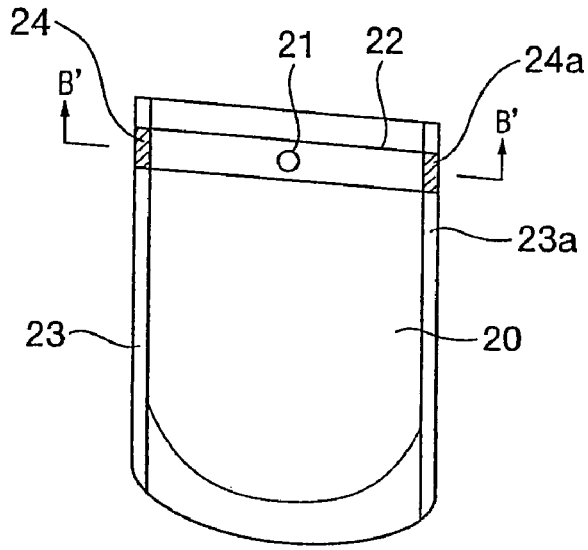
FIG. 5 PRIOR ART
FIG. 5 is an explanatory view showing a pouch with a straw hole based on the conventional technology.
Figure 6:
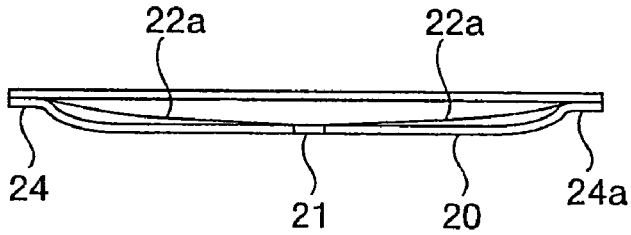
FIG. 6 PRIOR ART
FIG. 6 is a cross-sectional view taken along the line B'-B' of FIG. 5.
Figure 7:
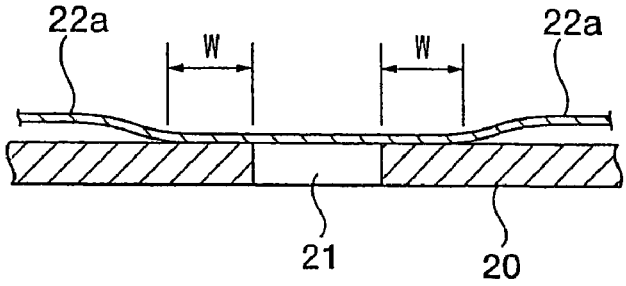
FIG. 7 PRIOR ART
FIG. 7 is an enlarged cross-sectional view showing the straw hole based on the conventional technology.

FIG. 4 shows a method of manufacturing the pouch 1 described above, and in this method, at first the straw hole 2 is punched by a straw hole punching machine 12 on the front-side film 4. Then a seal-material tape 6 is fed to the back side of this straw hole 2. This seal tape 6 has a hole temporally punched (or partially punched) by a temporally punching machine 13*a* with the size slightly larger than that of the straw hole 2. The temporally punched section 13 of this seal material tape 6 is guided to the back side of the straw hole 2, and then a periphery of the temporally punched section 13 is temporally heat-sealed by a temporally heat-sealing device 7. As previously described, the temporary heat seal is a "tack" seal. Then the front side film 4 and a rear side film 5 are aligned with each other by pinch rollers 14, 14*a*, and the section of the straw hole sealing material temporally sealed by the temporally sealing machine 7 is finally sealed by a finally sealing machine 11. The final seal is at a lower temperature and pressure than the first seal. A bottom seal 9*a* is applied by a bottom seal bar 9, and a side seal 8*a* is applied by a side seal bar 8. The pouch is finished, such as by cutting the pouch into discrete pieces by a cutter 10. It should be appreciated that prior to sealing the edge, a gusset 16 may be inserted between parallel edges of each panel, for a stand-up pouch.

In this figure, the sign 15 indicates a reel which winds up the seal material tape 6*a* after the seal material 3 is punched out therefrom.

As described above, in the pouch with a straw hole according to the present invention, only the back side of the straw hole is heat-sealed with a seal material, which provides the following advantageous effects.

1. In a manner that is different from the conventional type of pouches, there is no odd portion of the seal material of the invention that may cause a problem when the content is filled therein.

2. In a manner that is different from the conventional type of pouches, the seal material of the invention does not interfere with the side seal section, so that no pin holes are generated in the side seal section.

3. In a manner that is different from the conventional type of pouches, the pouch of the invention does not become thicker by the thickness of the seal material, so that no trouble occurs when the content is filled therein.

4. There is no odd tape left inside the pouch of the invention after sealing, so that the pouch is not contaminated by fungus or bacteria and the inside is always kept clean.

The present invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced other than as specifically described.

The invention claimed is:

1. A method of manufacturing a pouch with a straw hole, the method comprising the steps of:

feeding a front-side film forming one panel of the pouch and a back-side film forming an other panel, from a roll of material;

punching a straw hole in one panel of the pouch;

feeding a seal material tape with a plurality of temporally punched portions, and each temporal punched portion has a size slightly larger than that of the straw hole, to a rear side of the panel with the straw hole;

temporally sealing the temporally punched portion of the seal material tape over the straw hole by aligning one temporally punched portion of the seal material tape with the straw hole, separating the temporally punched portion from the seal material tape and temporally sealing the temporally punched portion to the one panel; and finally sealing the temporally punched portion to the one panel, and sealing the one panel to the other panel to form the pouch.

2. The method of manufacturing a pouch with a straw hole according to claim 1, further comprising the step of inserting a folded tape between the one panel and the other panel to provide a standing pouch.

3. The method of manufacturing a pouch with a straw hole according to claim 1, wherein said step of temporally sealing the temporally punched portion of the seal material tape over the straw hole further includes heat sealing the temporally punched portion at a higher temperature than a final heat seal temperature.

* * * * *

UNITED STATES PATENT AND TRADEMARK OFFICE

CERTIFICATE OF CORRECTION

PATENT NO. : 7,410,452 B2
APPLICATION NO. : 11/057635
DATED : August 12, 2008
INVENTOR(S) : R. Charles Murray et al.

It is certified that error appears in the above-identified patent and that said Letters Patent is hereby corrected as shown below:

Title page, Item (73) replace “International” with --Innovations--

Column 1, line 36, replace “that” first occurrence with --the--

Column 2, line 42, replace “with” with --width--

Signed and Sealed this

Twenty-eighth Day of October, 2008

JON W. DUDAS
*Director of the United States Patent and Trademark Office*